US009759013B2

(12) United States Patent
Radford et al.

(10) Patent No.: US 9,759,013 B2
(45) **Date of Patent: *Sep. 12, 2017**

(54) SELECTIVELY ACTUATING EXPANDABLE REAMERS AND RELATED METHODS

(71) Applicant: Baker Hughes Incorporated, Houston, TX (US)

(72) Inventors: Steven R. Radford, The Woodlands, TX (US); Marcus Oesterberg, Kingwood, TX (US); S. Richard Gentry, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 287 days.

This patent is subject to a terminal disclaimer.

(21) Appl. No.: 14/616,178

(22) Filed: Feb. 6, 2015

(65) Prior Publication Data

US 2015/0152686 A1 Jun. 4, 2015

Related U.S. Application Data

(63) Continuation of application No. 13/327,373, filed on Dec. 15, 2011, now Pat. No. 8,960,333.

(51) Int. Cl.
*E21B 10/32* (2006.01)
*E21B 10/34* (2006.01)
(Continued)

(52) U.S. Cl.
CPC ..... *E21B 7/28* (2013.01); *E21B 3/00* (2013.01); *E21B 10/322* (2013.01);
(Continued)

(58) Field of Classification Search
CPC ..... E21B 10/32; E21B 10/322; E21B 10/345
See application file for complete search history.

(56) References Cited

U.S. PATENT DOCUMENTS 1,678,075 A 7/1928 Phipps
2,069,482 A 2/1937 Seay
(Continued)

FOREIGN PATENT DOCUMENTS

EP 246789 A2 11/1987
EP 0594420 A1 4/1994
(Continued)

OTHER PUBLICATIONS

U.S. Appl. No. 60/399,531, filed Jul. 30, 2002, titled Expandable Reamer Apparatus for Enlarging Boreholes While Drilling and Method of Use, to Radford et al.
(Continued)

*Primary Examiner* — Cathleen Hutchins
(74) *Attorney, Agent, or Firm* — TraskBritt

(57) ABSTRACT

Expandable reamers are configured to operate in a first, retracted state in which a plurality of blades is in a retracted position when a sliding sleeve is in a first sleeve position and a seat is in a first seat position, to operate in a second, extended state in which the plurality of blades is movable to an extended position when the sliding sleeve is in at least a second sleeve position and the seat is in the first seat position, and to operate in a third, retracted state in which the plurality of blades is returned to the retracted position when the sliding sleeve is in the at least a second position and the seat is in a second seat position.

20 Claims, 9 Drawing Sheets

(51) Int. Cl.

| | |
|---|---|
| ***E21B 7/28*** | (2006.01) |
| ***E21B 3/00*** | (2006.01) |
| ***E21B 34/12*** | (2006.01) |
| *E21B 34/00* | (2006.01) |

(52) U.S. Cl.

CPC ..... *E21B 10/325* (2013.01); *E21B 34/12* (2013.01); *E21B 2034/007* (2013.01)

(56) References Cited

U.S. PATENT DOCUMENTS

| | | | |
|---|---|---|---|
| 2,136,518 | A | 11/1938 | Nixon |
| 2,177,721 | A | 10/1939 | Johnson et al. |
| 2,344,598 | A | 3/1944 | Church |
| 2,532,418 | A | 12/1950 | Page |
| 2,638,988 | A | 5/1953 | Williams |
| 2,754,089 | A | 7/1956 | Kammerer, Jr. |
| 2,758,819 | A | 8/1956 | Kammerer, Jr. |
| 2,834,578 | A | 5/1958 | Carr |
| 2,874,784 | A | 2/1959 | Baker, Jr. et al. |
| 2,882,019 | A | 4/1959 | Carr et al. |
| 3,083,765 | A | 4/1963 | Kammerer |
| 3,105,562 | A | 10/1963 | Stone et al. |
| 3,123,162 | A | 3/1964 | Rowley |
| 3,126,065 | A | 3/1964 | Chadderdon |
| 3,171,502 | A | 3/1965 | Kammerer |
| 3,211,232 | A | 10/1965 | Grimmer |
| 3,224,507 | A | 12/1965 | Cordary, Jr. |
| 3,283,834 | A | 11/1966 | Kammerer |
| 3,289,760 | A | 12/1966 | Kammerer |
| 3,351,137 | A | 11/1967 | Schulz et al. |
| 3,425,500 | A | 2/1969 | Fuchs |
| 3,433,313 | A | 3/1969 | Brown |
| 3,556,233 | A | 1/1971 | Gilreath |
| 4,098,335 | A | 7/1978 | Goad |
| 4,403,659 | A | 9/1983 | Upchurch |
| 4,458,761 | A | 7/1984 | Van Vreeswyk |
| 4,491,022 | A | 1/1985 | De La Cruz |
| 4,545,441 | A | 10/1985 | Williamson |
| 4,589,504 | A | 5/1986 | Simpson |
| 4,660,657 | A | 4/1987 | Furse et al. |
| 4,690,229 | A | 9/1987 | Raney |
| 4,693,328 | A | 9/1987 | Furse et al. |
| 4,842,083 | A | 6/1989 | Raney |
| 4,848,490 | A | 7/1989 | Anderson |
| 4,854,403 | A | 8/1989 | Ostertag et al. |
| 4,884,477 | A | 12/1989 | Smith et al. |
| 4,889,197 | A | 12/1989 | Boe |
| 4,893,678 | A | 1/1990 | Stokley et al. |
| 5,139,098 | A | 8/1992 | Blake |
| 5,211,241 | A | 5/1993 | Mashaw et al. |
| 5,224,558 | A | 7/1993 | Lee |
| 5,265,684 | A | 11/1993 | Rosenhauch |
| 5,293,945 | A | 3/1994 | Rosenhauch et al. |
| 5,305,833 | A | 4/1994 | Collins |
| 5,318,131 | A | 6/1994 | Baker |
| 5,318,137 | A | 6/1994 | Johnson et al. |
| 5,318,138 | A | 6/1994 | Dewey et al. |
| 5,332,048 | A | 7/1994 | Underwood et al. |
| 5,343,963 | A | 9/1994 | Bouldin et al. |
| 5,361,859 | A | 11/1994 | Tibbitts |
| 5,368,114 | A | 11/1994 | Tandberg et al. |
| 5,375,662 | A | 12/1994 | Echols, III et al. |
| 5,425,423 | A | 6/1995 | Dobson et al. |
| 5,437,308 | A | 8/1995 | Morin et al. |
| 5,443,129 | A | 8/1995 | Bailey et al. |
| 5,553,678 | A | 9/1996 | Barr et al. |
| 5,560,440 | A | 10/1996 | Tibbitts et al. |
| 5,740,864 | A | 4/1998 | de Hoedt et al. |
| 5,788,000 | A | 8/1998 | Maury et al. |
| 5,823,254 | A | 10/1998 | Dobson et al. |
| 5,862,870 | A | 1/1999 | Hutchinson et al. |
| 5,887,655 | A | 3/1999 | Haugen et al. |
| 6,039,131 | A | 3/2000 | Beaton |
| 6,059,051 | A | 5/2000 | Jewkes et al. |
| 6,109,354 | A | 8/2000 | Ringgenberg et al. |
| 6,116,336 | A | 9/2000 | Adkins et al. |
| 6,131,675 | A | 10/2000 | Anderson |
| 6,173,795 | B1 | 1/2001 | McGarian et al. |
| 6,189,631 | B1 | 2/2001 | Sheshtawy |
| 6,213,226 | B1 | 4/2001 | Eppink et al. |
| 6,227,312 | B1 | 5/2001 | Eppink et al. |
| 6,289,999 | B1 | 9/2001 | Dewey et al. |
| 6,325,151 | B1 | 12/2001 | Vincent et al. |
| 6,378,632 | B1 | 4/2002 | Dewey et al. |
| 6,488,104 | B1 | 12/2002 | Eppink et al. |
| 6,494,272 | B1 | 12/2002 | Eppink et al. |
| 6,615,933 | B1 | 9/2003 | Eddison |
| 6,668,949 | B1 | 12/2003 | Rives |
| 6,681,860 | B1 | 1/2004 | Yokley et al. |
| 6,702,020 | B2 | 3/2004 | Zachman et al. |
| 6,708,785 | B1 | 3/2004 | Russell et al. |
| 6,732,817 | B2 | 5/2004 | Dewey et al. |
| 7,048,078 | B2 | 5/2006 | Dewey et al. |
| 7,314,099 | B2 | 1/2008 | Dewey et al. |
| 7,389,828 | B2 | 6/2008 | Ritter et al. |
| 7,493,971 | B2 | 2/2009 | Nevlud et al. |
| 7,513,318 | B2 | 4/2009 | Underwood et al. |
| 7,900,717 | B2 | 3/2011 | Radford et al. |
| 8,028,767 | B2 | 10/2011 | Radford et al. |
| 8,235,144 | B2 | 8/2012 | Rasheed |
| 8,511,404 | B2 | 8/2013 | Rasheed |
| 8,528,668 | B2 | 9/2013 | Rasheed |
| 9,097,820 | B2 | 8/2015 | Rasheed |
| 2002/0070052 | A1 | 6/2002 | Armell |
| 2003/0029644 | A1 | 2/2003 | Hoffmaster et al. |
| 2003/0155155 | A1 | 8/2003 | Dewey et al. |
| 2004/0119607 | A1 | 6/2004 | Davies et al. |
| 2004/0134687 | A1 | 7/2004 | Radford et al. |
| 2006/0144623 | A1 | 7/2006 | Ollerensaw |
| 2006/0249307 | A1 | 11/2006 | Ritter et al. |
| 2007/0095573 | A1 | 5/2007 | Telfer |
| 2007/0163808 | A1 | 7/2007 | Campbell et al. |
| 2007/0205022 | A1 | 9/2007 | Treviranus et al. |
| 2008/0128169 | A1 | 6/2008 | Radford et al. |
| 2008/0128175 | A1 | 6/2008 | Radford et al. |
| 2010/0108394 | A1 | 5/2010 | Ollerenshaw et al. |
| 2010/0282511 | A1 | 11/2010 | Maranuk et al. |
| 2010/0288557 | A1 | 11/2010 | Radford |
| 2011/0073330 | A1 | 3/2011 | Radford |
| 2011/0073370 | A1 | 3/2011 | Gentry |
| 2011/0073371 | A1 | 3/2011 | Radford |
| 2011/0073376 | A1 | 3/2011 | Radford et al. |
| 2011/0155465 | A1 | 6/2011 | Allamon et al. |
| 2011/0284233 | A1 | 11/2011 | Wu et al. |
| 2013/0153300 | A1 | 6/2013 | Radford et al. |
| 2013/0256035 | A1 | 10/2013 | Radford et al. |
| 2013/0333879 | A1 | 12/2013 | Rasheed |
| 2014/0060933 | A1 | 3/2014 | Rasheed |
| 2014/0246236 | A1 | 9/2014 | Radford et al. |
| 2014/0246246 | A1 | 9/2014 | Radford |

FOREIGN PATENT DOCUMENTS

| | | | |
|---|---|---|---|
| EP | 1036913 | A1 | 10/2002 |
| EP | 1044314 | A1 | 3/2005 |
| EP | 1614852 | A1 | 11/2006 |
| EP | 2327857 | B1 | 3/2014 |
| GB | 2328964 | A | 3/1999 |
| GB | 2344607 | A | 6/2000 |
| GB | 2319276 | B | 2/2001 |
| GB | 2353310 | A | 2/2001 |
| GB | 2344122 | B | 4/2003 |
| GB | 2393461 | B | 10/2006 |
| GB | 2426269 | B | 2/2007 |
| GB | 2441286 | B | 3/2008 |
| GB | 2438333 | B | 12/2008 |
| GB | 2437878 | B | 7/2009 |
| GB | 2446745 | B | 8/2009 |
| GB | 2460096 | A | 11/2009 |
| GB | 2420803 | B | 1/2010 |
| GB | 2465504 | A | 5/2010 |
| GB | 2465505 | A | 5/2010 |
| GB | 2449594 | B | 11/2010 |

(56) References Cited

FOREIGN PATENT DOCUMENTS

| | | | |
|---|---|---|---|
| GB | 2476653 | A | 6/2011 |
| GB | 2455242 | B | 7/2011 |
| GB | 2470159 | B | 7/2012 |
| GB | 2473561 | B | 7/2012 |
| GB | 2479298 | B | 12/2013 |
| GB | 2521528 | A | 6/2015 |
| WO | 0031371 | A1 | 6/2000 |
| WO | 2008/150290 | A1 | 12/2008 |
| WO | 2009/156552 | A1 | 12/2009 |
| WO | 2011/080640 | A2 | 7/2011 |
| WO | 2013/166393 | A1 | 11/2013 |

OTHER PUBLICATIONS

International Search Report for International Application No. PCT/US2012/069162 mailed Jun. 21, 2013, 5 pages.
International Written Opinion for International Application No. PCT/US2012/069162 mailed Jun. 21, 2013, 4 pages.
International Preliminary Report on Patentability for International Application No. PCT/US2012/069162 mailed Jun. 17, 5 pages.

SELECTIVELY ACTUATING EXPANDABLE REAMERS AND RELATED METHODS

CROSS-REFERENCE TO RELATED APPLICATION

This application is a continuation of U.S. patent application Ser. No. 13/327,373, filed Dec. 15, 2011, now U.S. Pat. No. 8,960,333, issued Feb. 24, 2015, the disclosure of which is incorporated herein in its entirety by this reference.

TECHNICAL FIELD

The disclosure relates generally to expandable reamers for forming boreholes in subterranean formations. More specifically, the disclosed embodiments relate to expandable reamers that may be selectively actuated to extend and retract blades of the expandable reamers.

BACKGROUND

Expandable reamers are typically employed for enlarging boreholes in subterranean formations. In drilling oil, gas, and geothermal wells, casing is usually installed and cemented to prevent the well bore walls from caving into the borehole while providing requisite shoring for subsequent drilling operation to achieve greater depths. Casing is also installed to isolate different formations, to prevent cross flow of formation fluids, and to enable control of formation fluids and pressure as the borehole is drilled. To increase the depth of a previously drilled borehole, new casing is laid within and extended below the original casing. The diameter of any subsequent sections of the well may be reduced because the drill bit and any further casing must pass through the original casing. Such reductions in the borehole diameter may limit the production flow rate of oil and gas through the borehole. Accordingly, a borehole may be enlarged in diameter when installing additional casing to enable better production flow rates of hydrocarbons through the borehole.

One approach used to enlarge a borehole involves employing an extended bottom-hole assembly with a pilot drill bit at the end and a reamer assembly some distance above the pilot drill bit. This arrangement permits the use of any standard rotary drill bit type (e.g., a rolling cone bit or a fixed cutter bit), as the pilot bit and the extended nature of the assembly permit greater flexibility when passing through tight spots in the borehole as well as the opportunity to effectively stabilize the pilot drill bit so that the pilot drill bit and the following reamer will traverse the path intended for the borehole. This aspect of an extended bottom hole assembly is particularly significant in directional drilling. Expandable reamers are disclosed in, for example, U.S. Pat. No. 7,900,717, issued Mar. 8, 2011, to Radford et al., U.S. Pat. No. 8,028,767, issued Oct. 4, 2011, to Radford et al., and U.S. Patent Application Pub. No. 2011/0073371, published Mar. 31, 2011, to Radford, the disclosure of each of which is incorporated herein in its entirety by this reference. The blades in such expandable reamers are initially retracted to permit the tool to be run through the borehole on a drill string, and, once the tool has passed beyond the end of the casing, the blades are extended so the bore diameter may be increased below the casing.

BRIEF SUMMARY

In some embodiments, expandable reamers for use in boreholes in subterranean formations comprise a housing defining a central bore. A plurality of blades is carried by the housing and is movable between a retracted position and an extended position responsive to flow of drilling fluid. A sliding sleeve is disposed within the central bore and is coupled to the housing. The sliding sleeve defines an axial fluid passageway and comprises at least one port in a sidewall of the sliding sleeve. The sliding sleeve is movable between a first sleeve position and at least a second sleeve position to alter flow of drilling fluid. A seat is disposed within and coupled to the sliding sleeve. The seat is movable between a first seat position and a second seat position to alter flow of drilling fluid. At least one sealing member is configured to form a seal between the housing and the sliding sleeve. The at least one port in the sidewall of the sliding sleeve is located on a first side of the at least one sealing member in the first sleeve position and is movable to a second, opposing side of the at least one sealing member when the sliding sleeve is in the second sleeve position. Such expandable reamers are configured to operate in a first, retracted state in which the plurality of blades is in the retracted position when the sliding sleeve is in the first sleeve position and the seat is in the first seat position, to operate in a second, extended state in which the plurality of blades is movable to the extended position when the sliding sleeve is in the at least a second sleeve position and the seat is in the first seat position, and to operate in a third, retracted state in which the plurality of blades is returned to the retracted position when the sliding sleeve is in the at least a second position and the seat is in the second seat position.

In other embodiments, methods of using expandable reamers in boreholes in subterranean formations comprise flowing a drilling fluid through a central bore defined by a housing carrying a plurality of blades. A first obstruction is disposed in the central bore to engage a sliding sleeve located within the central bore, the sliding sleeve defining an axial fluid passageway within the central bore. Flow of the drilling fluid is redirected from the axial fluid passageway to at least one port in the sliding sleeve to exert pressure causing at least one blade of the plurality of blades to move from a retracted state to an extended state by obstructing the axial fluid passageway with the first obstruction. The at least one blade is extended responsive to the redirected flow of the drilling fluid. A second obstruction is disposed in the central bore to engage a seat located within the sliding sleeve. The at least one port is disposed on a second side of a seal opposing a first side of the seal on which the at least one blade is disposed by displacing the sliding sleeve responsive to the second obstruction disposed in the central bore. Flow of the drilling fluid is redirected through the at least one port on the second, opposing side of the seal. Retraction of the at least one blade is allowed responsive to the redirected flow of the drilling fluid.

BRIEF DESCRIPTION OF THE DRAWINGS

While the specification concludes with claims particularly pointing out and distinctly claiming what are regarded as embodiments of the invention, various features and advantages of disclosed embodiments may be more readily ascertained from the following description when read in conjunction with the accompanying drawings, in which:

DETAILED DESCRIPTION

The illustrations presented herein are not meant to be actual views of any particular expandable reamer or component thereof, but are merely idealized representations employed to describe illustrative embodiments. Thus, the drawings are not necessarily to scale. Additionally, elements common between figures may retain the same or similar numerical designation.

Disclosed embodiments relate generally to expandable reamers that may be selectively actuated to extend and retract blades of the expandable reamers. More specifically, disclosed are expandable reamers that may be extended by placing a first obstruction into a flow path of drilling fluid and may be retracted by placing a second obstruction into the flow path of drilling fluid.

As used herein, the term "drilling fluid" means and includes any fluid that may be directed down a drill string during drilling of a subterranean formation. For example, drilling fluids include liquids, gases, combinations of liquids and gases, fluids with solids in suspension with the fluids, oil-based fluids, water-based fluids, air-based fluids, and muds.

Figure 1:
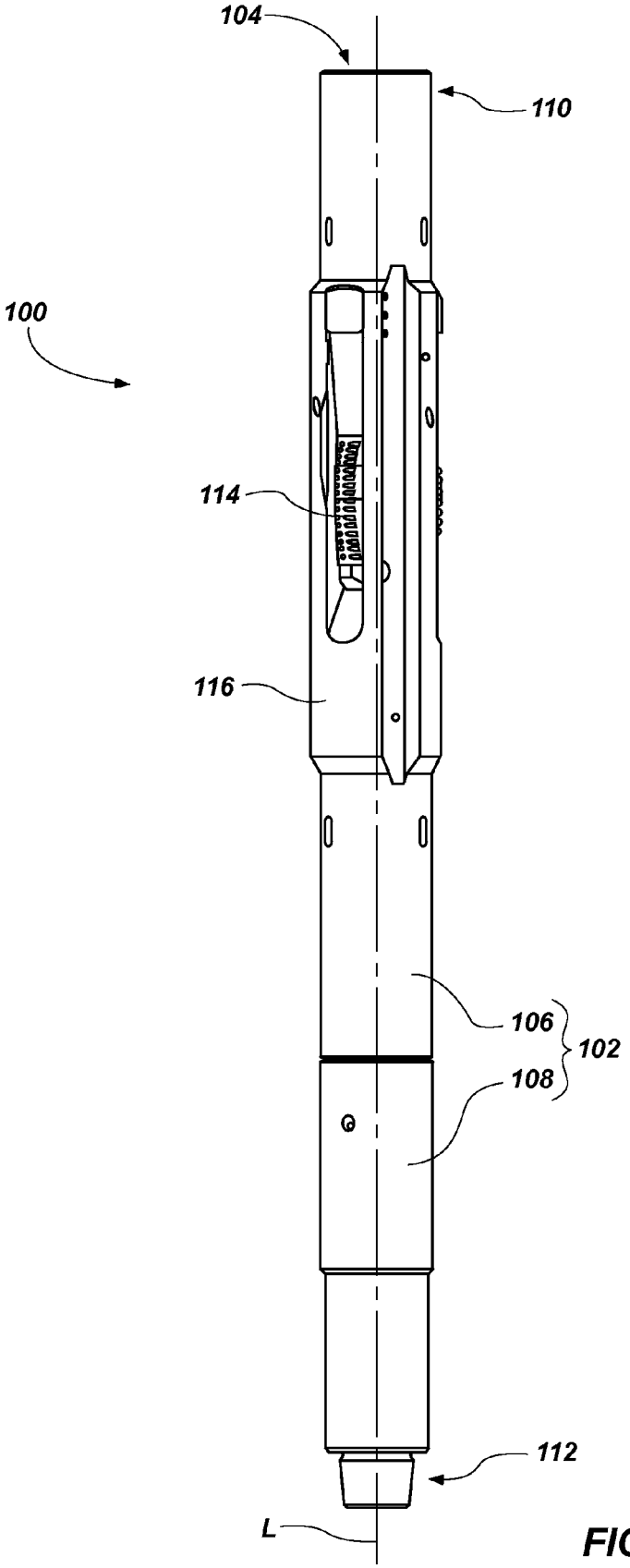
FIG. 1 is a perspective view of an expandable reamer for use in a borehole in a subterranean formation.

Referring to FIG. 1, a perspective view of an expandable reamer 100 for use in a borehole in a subterranean formation is shown. Some of the components of the expandable reamer 100 may generally be similar or identical to those described in, for example, U.S. Pat. No. 7,900,717, issued Mar. 8, 2011, to Radford et al., U.S. Pat. No. 8,028,767, issued Oct. 4, 2011, to Radford et al., and U.S. Patent Application Pub. No. 2011/0073371, published Mar. 31, 2011, to Radford, the disclosure of each of which is incorporated herein in its entirety by this reference. Briefly, the expandable reamer 100 may comprise a housing 102 having a longitudinal axis L and defining a central bore 104 extending through the housing 102. The housing 102 may comprise a generally cylindrical tubular structure. In some embodiments, the housing 102 may comprise an upper sub housing 106 and a lower sub housing 108 connected to the upper sub housing 106. The terms "lower" and "upper," as used herein, refer to the typical orientation of the expandable reamer 100 when positioned within a borehole. In alternative embodiments, the housing 102 may comprise more than two sub housings or may comprise a single, unitary sub housing. The housing 102 of the expandable reamer 100 may have an upper end 110 and a lower end 112. The lower end 112 of the housing 102 may include a connection portion (e.g., a threaded male pin member) for connecting the lower end 112 to another section of a drill string or another component of a bottom-hole assembly (BHA), such as, for example, a drill collar or collars carrying a pilot drill bit for drilling a borehole. Similarly, the upper end 110 of the housing 102 may include a connection portion (e.g., a threaded female box member) for connecting the upper end 110 to another section of a drill string or another component of a bottom-hole assembly (BHA).

A plurality of blades 114 (only one blade 114 is visible, and other blades 114 are obscured by the housing 102) is circumferentially spaced around the housing 102, as further described below, and is carried by the housing 102 between the upper end 110 and the lower end 112. The blades 114 are shown in an initial, retracted position within the housing 102 of the expandable reamer 100, but are configured selectively to extend responsive to application of hydraulic pressure into an extended position when actuated (see FIGS. 3, 4, and 8) and return to the retracted position when de-actuated, as will be described herein. The expandable reamer 100 may be configured to engage the walls of a subterranean formation defining a borehole with the blades 114 to remove formation material when the blades 114 are in the extended position, and to disengage from the walls of the subterranean formation when the blades 114 are in the retracted position. While the expandable reamer 100 shown includes three blades 114, the expandable reamer 100 may include any number of blades 114, such as, for example, one, two, four, or greater than four blades, in alternative embodiments. Moreover, though the blades 114 shown are symmetrically circumferentially positioned around the longitudinal axis L of the housing 102 at the same longitudinal position between the upper and lower ends 110 and 112, the blades 114 may also be positioned circumferentially asymmetrically around the longitudinal axis L, at different longitudinal positions between the upper and lower ends 110 and 112, or both in alternative embodiments.

The expandable reamer 100 may optionally include a plurality of stabilizers 116 extending radially outwardly from the housing 102. Such stabilizers 116 may center the expandable reamer 100 in the borehole while tripping into position through a casing or liner string and while drilling and reaming the borehole by contacting and sliding against the wall of the borehole. In other embodiments, the expandable reamer 100 may lack such stabilizers 116. In such embodiments, the housing 102 may comprise a larger outer diameter in the longitudinal portion where the stabilizers 116 are shown in FIG. 1 to provide a similar centering function as provided by the stabilizers 116. The stabilizers 116 may stop or limit the extending motion of the blades 114 (see FIGS. 3, 4, and 8), determining the extent to which the blades 114 extend to engage a borehole. The stabilizers 116 may optionally be configured for removal and replacement by a technician, particularly in the field, allowing the extent to which the blades 114 extend to engage the borehole to be selectively increased or decreased to a preselected and determined degree.

Figure 2:
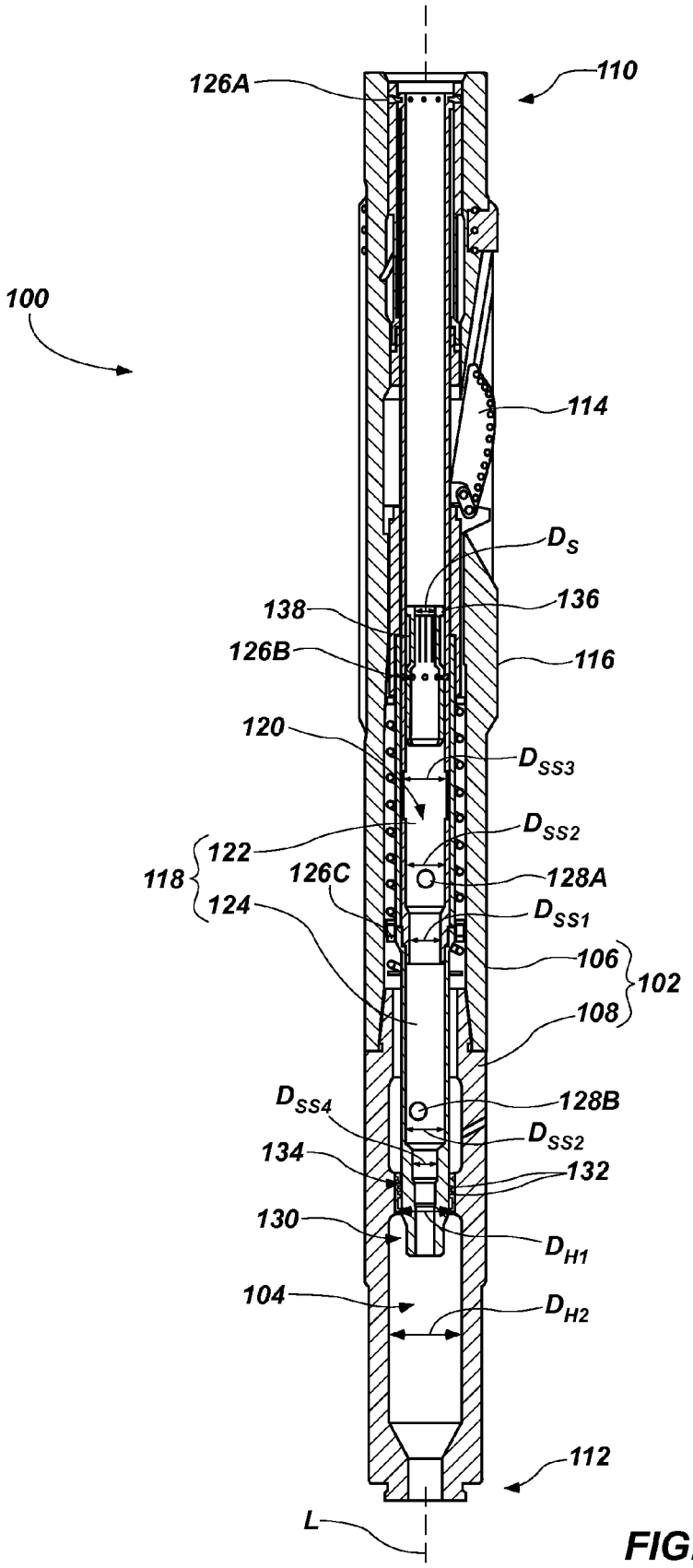
FIG. 2 is a cross-sectional view of the expandable reamer of FIG. 1 in a first state.

Referring to FIG. 2, a cross-sectional view of the expandable reamer 100 of FIG. 1 in a first operational state is shown. This first state may correspond to an initial, pre-actuation, retracted state. The expandable reamer 100 may include an actuation mechanism configured to selectively extend and retract the blades 114. The actuation mechanism may include a sliding sleeve 118 disposed within the central bore 104 and coupled to the housing 102. The sliding sleeve 118 may be in a first sleeve position when coupled to the housing 102 and may be movable to at least a second sleeve position when detached from the housing 102 (see FIG. 3). The sliding sleeve 118 may comprise a generally cylindrical tubular structure defining an axial fluid passageway 120. In some embodiments, the sliding sleeve 118 may comprise an upper sleeve member 122 and a lower sleeve member 124 connected to the upper sleeve member 122. In alternative embodiments, the sliding sleeve 118 may comprise more than two sleeve members or may comprise a single, unitary member.

The sliding sleeve 118 may be configured to move relative to the housing 102 to alter a flow path of drilling fluid through the expandable reamer 100. For example, the sliding sleeve 118 may be coupled to the housing 102 by detachable hardware 126A. The detachable hardware 126A may comprise, for example, locking dogs, exploding bolts, or shear screws. When detached, the detachable hardware 126A may enable the sliding sleeve 118 to move axially (e.g., by sliding axially downward) relative to the housing 102 from the first sleeve position to the second sleeve position (see FIG. 3).

The sliding sleeve 118 may comprise at least one port 128 in a sidewall of the sliding sleeve 118. For example, the sliding sleeve 118 may comprise at least one first port 128A extending through the sliding sleeve 118 at a first position along the longitudinal axis L and at least one second port 128B at a second, different (e.g., lower) position along the longitudinal axis L. As a specific, non-limiting example, the sliding sleeve 118 may comprise a plurality of first ports 128A through the sidewall of the upper sleeve member 122 and a plurality of second ports 128B through the sidewall of the lower sleeve member 124.

An inner diameter $D_{SS}$ of the sliding sleeve 118 may not be constant. For example, the inner diameter $D_{SS1}$ of the sliding sleeve 118 may be smaller (i.e., constricted) at an axial location between the first ports 128A and the second ports 128B than the inner diameter $D_{SS2}$ of the sliding sleeve 118 at the axial positions of the first ports 128A and the second ports 128B. Furthermore, the inner diameter $D_{SS3}$ of the sliding sleeve 118 may be greater (i.e., expanded) at an axial location above the first ports 128A. In addition, the inner diameter $D_{SS4}$ of the sliding sleeve 118 may be smaller at a lower end 130 of the sliding sleeve 118. The reduction in inner diameter $D_{SS4}$ at the lower end 130 of the sliding sleeve 118 may enable the sliding sleeve 118 to engage with an obstruction. In some embodiments, the lower end 130 of the sliding sleeve 118 may comprise a seat, such as, for example, a ball seat, a ball trap, a solid seat, an expandable seat, or other seats known in the art for engaging with obstructions to alter flow paths in expandable reamers 100, coupled to the lower sleeve member 124. Thus, the sliding sleeve 118 may be configured to engage with an obstruction to alter a flow path of drilling fluid through the expandable reamer 100.

The expandable reamer 100 may include at least one sealing member 132 configured to form a seal between the housing 102 and the sliding sleeve 118. For example, a plurality of sealing members 132 may be interposed between the housing 102 and the sliding sleeve 118 proximate the lower end 130 of the sliding sleeve 118, forming a seal 134 between the housing 102 and the sliding sleeve 118. The sealing members 132 may form the seal 134 between the housing 102 and the sliding sleeve 118 regardless of the sleeve position of the sliding sleeve 118. In other words, the seal 134 may be maintained before, during, and after extension and retraction of the blades 114. The sealing members 132 may comprise, for example, O-rings, omni-directional sealing rings (i.e., sealing rings that prevent flow from one side of the sealing rings to the other side of the sealing rings regardless of flow direction), unidirectional sealing rings (i.e., sealing rings that prevent flow from one side of the sealing ring to the other side of the sealing ring in only one flow direction), V-packing, and other members for forming seals between components of expandable reamers 100 known in the art. As a specific, non-limiting example, the sealing members 132 may comprise D-seal O-rings, which may comprise flexible and compressible tubular members having "D" shaped cross-sections extending circumferentially to form circular members. Thus, the sealing member 132 may form the seal 134 between the housing 102 and the sliding sleeve 118 when the expandable reamer 100 is in the first state (i.e., the initial, pre-actuation, retracted state) and when the sliding sleeve 118 is in the first and second positions (see FIG. 3). The lower end 130 of the sliding sleeve 118 may be located below the seal 134, but above and distanced from the lower end 112 of the housing 102.

An inner diameter $D_H$ of the housing 102 may not be constant. For example, the inner diameter $D_{H1}$ of the housing 102 may be smaller at an axial location of the seal 134 than the inner diameter $D_{H2}$ at axial locations immediately above and below the seal 134. When the sliding sleeve 118 is in the first sleeve position, the second ports 128B may be exposed by the greater inner diameter $D_{H2}$ of the housing 102, enabling drilling fluid to flow through the second ports 128B and out of the axial fluid passageway 120 into the central bore 104. The first ports 128A may optionally be located at an axial location where the inner diameter $D_H$ of the housing 102 is smaller than the inner diameter $D_{H2}$ of the housing 102 adjacent to the seal 134 when the sliding sleeve 118 is in the first sleeve position. Thus, the housing 102 may obstruct or at least impede flow of drilling fluid through the first ports 128A to the central bore 104. In other words, drilling fluid may more easily flow through the second ports 128B and through the axial fluid passageway 120 than through the first ports 128A when the sliding sleeve 118 is in the first sleeve position in some embodiments. In other embodiments, the first ports 128A may be exposed at a portion of the housing 102 having an inner diameter $D_{H2}$ greater than the inner diameter $D_{H1}$ of the housing 102 at the seal 134 when the sliding sleeve 118 is in the first sleeve position.

A seat 136 may be disposed within and coupled to the sliding sleeve 118. The seat 136 may be in a first seat position and may be movable to a second seat position (see FIG. 4) when detached from the sliding sleeve 118 to alter flow of drilling fluid through the expandable reamer 100. For example, the seat 136 may be configured to engage with another obstruction to alter a flow path of drilling fluid through the expandable reamer 100. The seat 136 may comprise, for example, a collet sleeve 138 configured to engage with the other obstruction and to detach from the sliding sleeve 118 when the second obstruction engages with the collet sleeve 138. The collet sleeve 138 may also be configured to expand to enable the other obstruction to disengage from the seat 136 and pass through the collet sleeve 138. For example, the collet sleeve 138 may comprise a plurality of collet fingers that may expand after the collet sleeve 138 has detached from the sliding sleeve 118 and moved axially relative to the sliding sleeve 118 from the first seat position to the second seat position, where the seat 136 may be axially aligned with an inner diameter $D_{SS3}$ of the sliding sleeve 118 that is greater (i.e., expanded) at an axial location above the first ports 128A, enabling the collet sleeve 138 to expand within the larger inner diameter $D_{SS3}$ of the sliding sleeve 118. The seat 136 may have a diameter $D_S$ smaller than a greatest inner diameter $D_{SS2}$ of the sliding sleeve 118, but greater than a smallest inner diameter $D_{SS4}$ of the sliding sleeve 118. The seat 136 may be coupled to the sliding sleeve 118 by detachable hardware 126B. The detachable hardware 126B may comprise, for example, locking dogs, exploding bolts, or shear screws.

When in use, drilling fluid may flow from the upper end 110 of the expandable reamer 100, down through the axial fluid passageway 120 defined by the sliding sleeve 118, and out the lower end 112 of the expandable reamer 100. Drilling fluid may also flow through the second ports 128B and optionally through the first ports 128A. The drilling fluid flowing through the first and second ports 128A and 128B may be insufficient to actuate the expandable reamer 100 (i.e., to extend the blades 114). In addition, or in the alternative, detachable hardware 126C, such as, for example, locking dogs, shear screws, or exploding bolts, may secure the blades 114 in the retracted state regardless of the pressure of the drilling fluid flowing through the first and second ports 128A and 128B. Thus, the expandable reamer 100 may remain in the first state until actuated. In the first state of operation of the expandable reamer 100, the plurality of blades 114 may be in the retracted position, the sliding sleeve 118 may be coupled to the housing 102 in the first sleeve position, and the seat 136 may be coupled to the sliding sleeve 118 in the first seat position.

Figure 3:
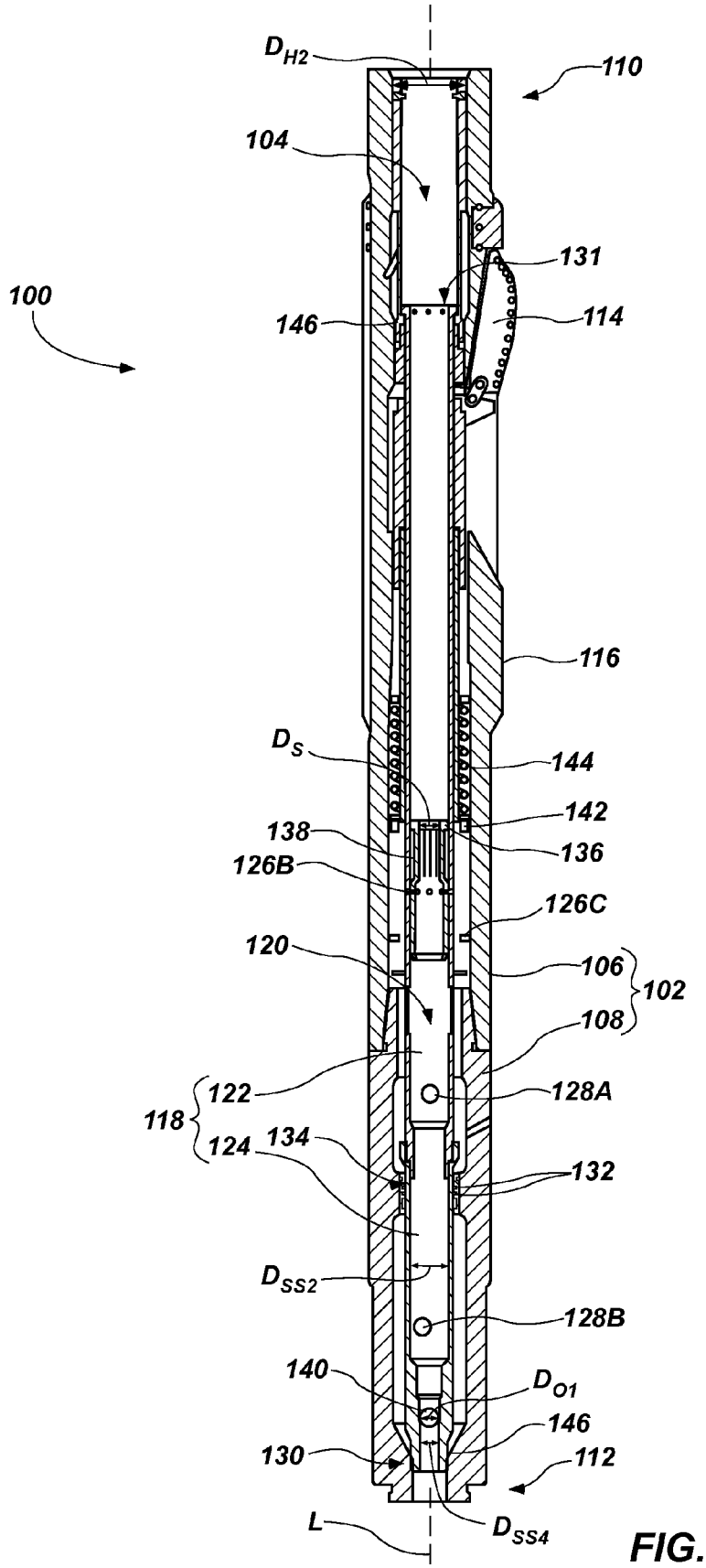
FIG. 3 is a cross-sectional view of the expandable reamer of FIG. 2 in a second state.

Referring to FIG. 3, a cross-sectional view of the expandable reamer 100 of FIG. 2 in a second operational state is shown. This second state may correspond to a subsequent, actuated, extended state. To place the expandable reamer 100 in the second state, a first obstruction 140 may be placed in the central bore 104. For example, the first obstruction 140 may be dropped into a drilling fluid flow path of a drill string (not shown) and travel down the drill string to the expandable reamer 100, where it may enter the central bore 104. The first obstruction 140 may comprise, for example, a ball (e.g., a sphere or ovoid) comprising a material suitable for use in a downhole environment (e.g., a metal, a polymer, a particle- or fiber-matrix composite, etc.). The first obstruction 140 may engage with the sliding sleeve 118 to obstruct the axial fluid passageway 120. For example, the first obstruction 140 may have a diameter $D_{O1}$ smaller than the diameter $D_S$ of the seat 136, but greater than the smallest inner diameter $D_{SS4}$ of the sliding sleeve 118. Thus, the first obstruction 140 may pass through the seat 136 and become lodged in the sliding sleeve 118 at the smallest inner diameter $D_{SS4}$ of the sliding sleeve 118.

Obstruction of the axial fluid passageway 120 may move the sliding sleeve 118 relative to the housing 102 from the first sleeve position (see FIG. 2) to the second sleeve position. For example, obstruction of the axial fluid passageway may cause drilling fluid to exert a pressure against the first obstruction 140 engaged with the sliding sleeve 118. The pressure exerted by the drilling fluid against the first obstruction 140 engaged with the sliding sleeve 118 may be sufficient to detach the sliding sleeve 118 from the housing 102. For example, the pressure exerted by the drilling fluid may be sufficient to shear detachable hardware 126A (see FIG. 2) comprising shear screws coupling the sliding sleeve 118 to the housing 102.

Upon detaching the sliding sleeve 118 from the housing 102, the pressure exerted against the first obstruction 140 engaged with the sliding sleeve 118 may also be sufficient to move the sliding sleeve 118 relative to the housing 102. For example, the sliding sleeve 118 may slide downward in response to the pressure exerted by the drilling fluid from the first sleeve position (see FIG. 2) to the second sleeve position. A shoulder at the upper end 131 of the sliding sleeve 118 may engage with a stop 146 (e.g., a ledge) within the central bore 104 defined by the housing 102 to stop movement of the sliding sleeve 118 at the second sleeve position. Once the sliding sleeve 118 has moved, the first ports 128A may remain on a first side of the seal 134 (e.g., an upper side of the seal 134), and the second ports 128B may have passed from the first side of the seal 134 to a second, opposing side of the seal 134 (e.g., a lower side of the seal 134).

Obstruction of the axial fluid passageway 120 may cause the blades 114 to move from the retracted position (see FIG. 2) to the extended position. For example, obstruction of the axial fluid passageway 120 may redirect flow of drilling fluid from the axial fluid passageway 120, through the first ports 128A located on the first side of the seal 134 (e.g., an upper side of the seal 134), to exert a pressure against a push sleeve 142. The pressure exerted by the redirected drilling fluid may be sufficient to move the push sleeve 142 and compress a spring 144 engaged with the push sleeve 142. Movement of the sliding sleeve 118 relative to the housing 102 may also release detachable hardware 126C that previously held the push sleeve 142 and the blades 114 to which the push sleeve 142 is connected in their retracted position. As a specific, non-limiting example, the detachable hardware 126C may comprise locking dogs as disclosed in U.S. Pat. No. 7,900,717, issued Mar. 8, 2011, to Radford et al., or U.S. Pat. No. 8,028,767, issued Oct. 4, 2011, to Radford et al., the disclosure of each of which is incorporated herein in its entirety by this reference. Movement of the push sleeve 142 may translate to corresponding movement of the blades 114. The blades 114 may move to the extended position to engage with a wall of a subterranean formation. In alternative embodiments, obstruction of the axial fluid passageway 120 may redirect flow of drilling fluid from the axial fluid passageway 120, through the first ports 128A on the first side of the seal 134 to exert a pressure directly against the blades 114. Thus, fluid flowing through the first ports 128A may extend and maintain the blades 114 in their extended position, and fluid flowing through the second ports 128B may flow past the expandable reamer 100 (e.g., to a BHA below the expandable reamer 100). In the second state of operation of the expandable reamer 100, the plurality of blades 114 may have moved from the retracted position to the extended position and may be selectively movable between the extended and retracted positions, the sliding sleeve 118 may have moved from the first sleeve position to the second sleeve position, and the seat 136 may remain coupled to the sliding sleeve 118 in the first seat position.

In embodiments where the first obstruction 140 is compressible (e.g., comprises a compressible polymer material such as, for example, rubber), the first obstruction 140 may disengage from the sliding sleeve 118 to return the blades 114 to a retracted position. For example, a pressure of drilling fluid flowing through the expandable reamer 100 in the second state may be increased, and the pressure of the drilling fluid may force the first obstruction 140 through the sliding sleeve 118, and out of the expandable reamer 100. The first obstruction 140 may then pass down through the drill string and be caught in a capture screen (e.g., a mesh basket) disposed in the drill string below the expandable reamer 100, as known in the art. Drilling fluid may be redirected from the first and second ports 128A and 128B to flow through the axial fluid passageway 120 defined by the sliding sleeve 118. Thus, the drilling fluid may not exert pressure against the push sleeve 142 sufficient to compress the spring 144. The spring 144 may expand and move the push sleeve 142 to its initial position (see FIG. 2). Movement of the push sleeve 142 may translate to movement of the blades 114 to their retracted position (see FIG. 2). Deploying another first obstruction 140 into the central bore 104 may return the blades 114 to their extended position in the same manner as described previously. Thus, the blades 114 may be selectively extended and retracted in some embodiments. In other embodiments, the first obstruction 140 may remain engaged with the sliding sleeve 118 for so long as the expandable reamer 100 remains in the borehole.

In addition or in the alternative, reduction in the pressure of the drilling fluid against the push sleeve 142 (or directly against the blades 114 in some embodiments) may allow the spring 144 to expand and retract the blades 114. Raising the pressure of the drilling fluid against the push sleeve 142 (or directly against the blades 114 in some embodiments) may compress the spring 144 and extend the blades 114. In this way, the blades 114 may be selectively extended and retracted when the expandable reamer 114 is in the second state of operation.

Figure 4:
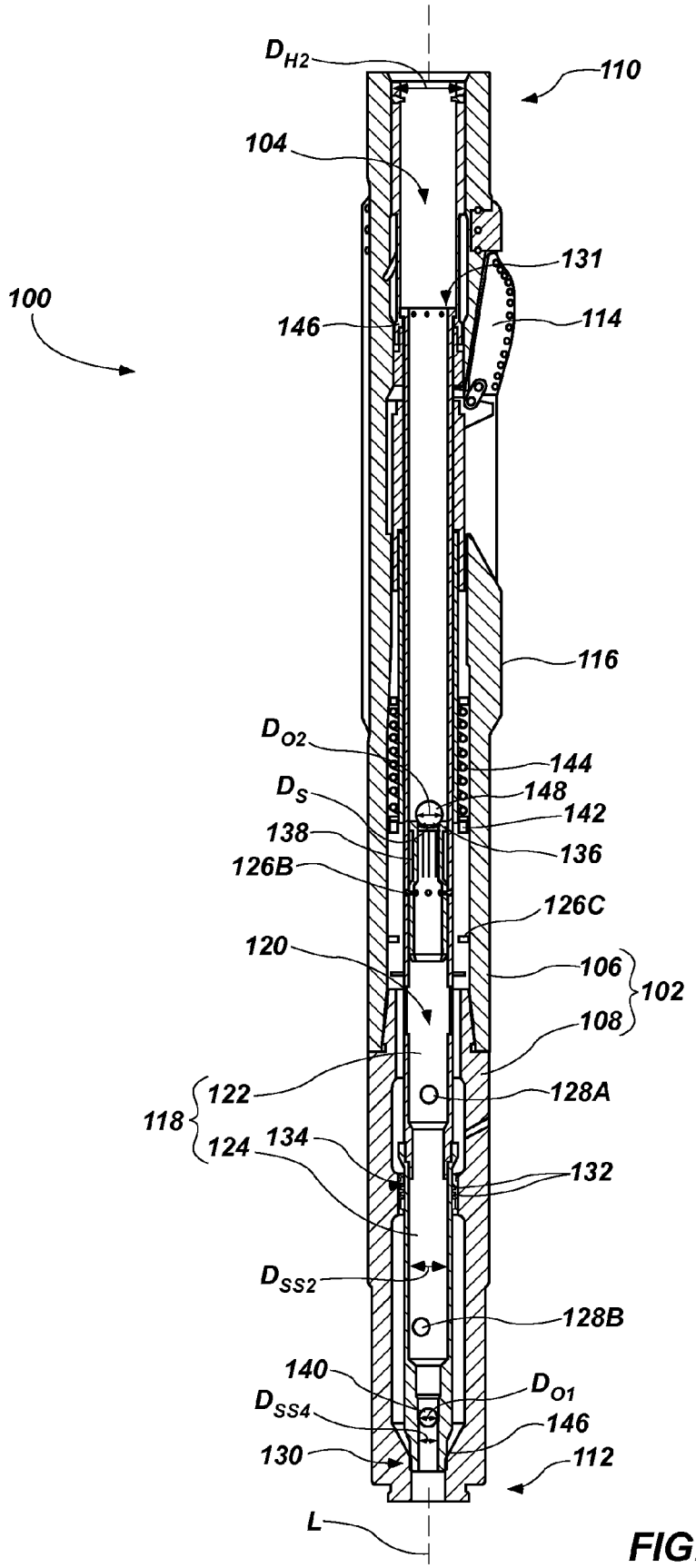
FIG. 4 is a cross-sectional view of the expandable reamer of FIG. 2 in the second state and transitioning to a third state.

Referring to FIG. 4, a cross-sectional view of the expandable reamer 100 of FIG. 2 still in the second state, but transitioning to a third state is shown. This third state may correspond to a final, de-actuated, retracted state. To transition the expandable reamer 100 from the second state to the third state, a second obstruction 148 may be placed in the central bore 104. For example, the second obstruction 148 may be dropped into a drilling fluid flow path of a drill string (not shown) and travel down the drill string to the expandable reamer 100, where it may enter the central bore 104. The second obstruction 148 may comprise, for example, a ball (e.g., a sphere or ovoid) comprising a material suitable for use in a downhole environment (e.g., a metal, a polymer, a composite, etc.). The second obstruction 148 may engage with the seat 136 to obstruct the axial fluid passageway 120. For example, the second obstruction 148 may have a diameter $D_{O2}$ greater than the diameter $D_S$ of the seat 136. In other words, the second obstruction 148 may have an average diameter $D_{O2}$ greater than an average diameter $D_{O1}$ of the first obstruction 140. Thus, the second obstruction 148 may become lodged in the seat 136.

Figure 5:
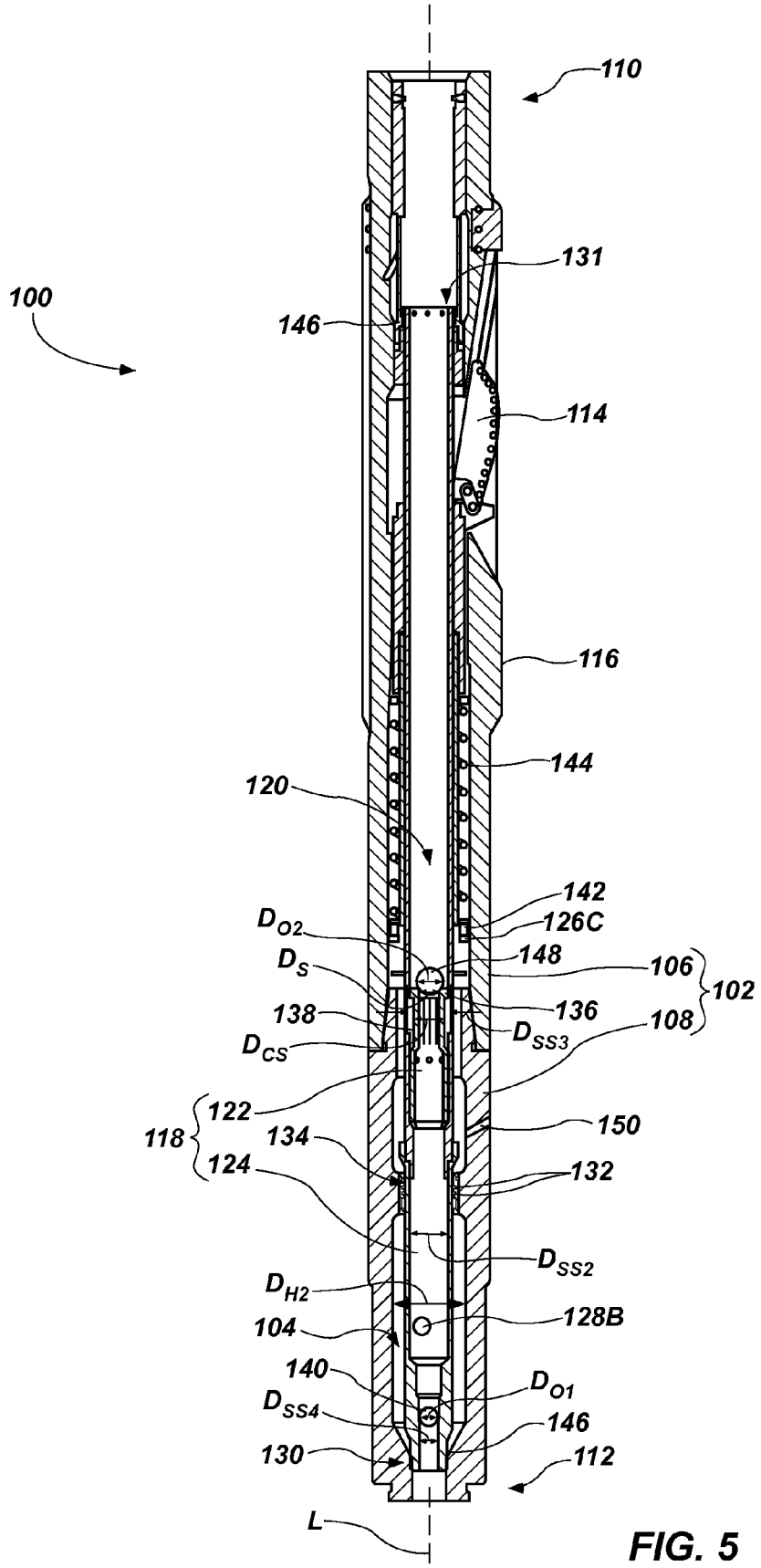
FIG. 5 is a cross-sectional view of the expandable reamer of FIG. 2 in the third state.

Obstruction of the axial fluid passageway 120 may cause the seat 136 to detach from the sliding sleeve 118 and move from the first seat position to the second seat position (see FIG. 5). For example, obstruction of the axial fluid passageway 120 may cause drilling fluid to exert a pressure against the second obstruction 148 and the seat 136. The pressure may be sufficient to detach the seat 136 from the sliding sleeve 118. For example, the pressure may be sufficient to shear detachable hardware 126B comprising shear screws coupling the seat 136 to the sliding sleeve 118. Once the seat 136 is detached from the sliding sleeve 118, the seat 136 may move relative to the sliding sleeve 118 from the first seat position to the second seat position (see FIG. 5) to redirect flow of the drilling fluid through the expandable reamer 100.

Referring to FIG. 5, a cross-sectional view of the expandable reamer of FIG. 2 in the third state is shown. As stated previously, the third state may correspond to a final, de-actuated, retracted state. The seat 136 may obstruct the first ports 128A (see FIG. 4) to redirect flow of the drilling fluid through the expandable reamer 100 when the seat 136 is in the second seat position. For example, the detached seat 136 may travel axially downward within the sliding sleeve 118 until it contacts a portion of the sliding sleeve 118 having an inner diameter $D_{SS3}$ less than an outer diameter $D_{CS}$ of the collet sleeve 138. After movement of the seat 136 to the second seat position, a portion of the collet sleeve 138 (e.g., a solid lower sleeve portion from which the collet fingers extend) may obstruct the first ports 128A (see FIG. 4). Accordingly, the drilling fluid may no longer exert pressure against the push sleeve 142 sufficient to compress the spring 144 and maintain the blades 114 in an extended position. A pressure relief mechanism 150 (e.g., a bleed nozzle or bleed valve) may enable drilling fluid that previously exerted pressure against the push sleeve 142 to exit the expandable reamer 100 out into the borehole. The spring 144 may extend, displacing the push sleeve 142 and retracting the blades 114 from their extended position (see FIGS. 3 and 4) to their retracted position. In this way, the blades 114 may move to the retracted position to cease engagement with a subterranean formation in a borehole. In the third state of operation of the expandable reamer 100, the plurality of blades 114 may return from the extended position (see FIGS. 3 and 4) to the retracted position, the sliding sleeve 118 may be in the second sleeve position, and the seat 136 may have moved from the first seat position (see FIGS. 2 through 4) to the second seat position. This retraction of the blades 114 may be irreversible so long as the expandable reamer 100 remains in the borehole. After the expandable reamer 100 is extracted from the borehole, the various components (e.g., the sliding sleeve 118, the seat 136, the collet sleeve 138, and the first and second obstructions 140 and 148) may optionally be reset to the first state (i.e., the initial, pre-actuation, retracted state shown in FIG. 1), and the expandable reamer 100 may be redeployed in the same or another borehole.

Figure 6:
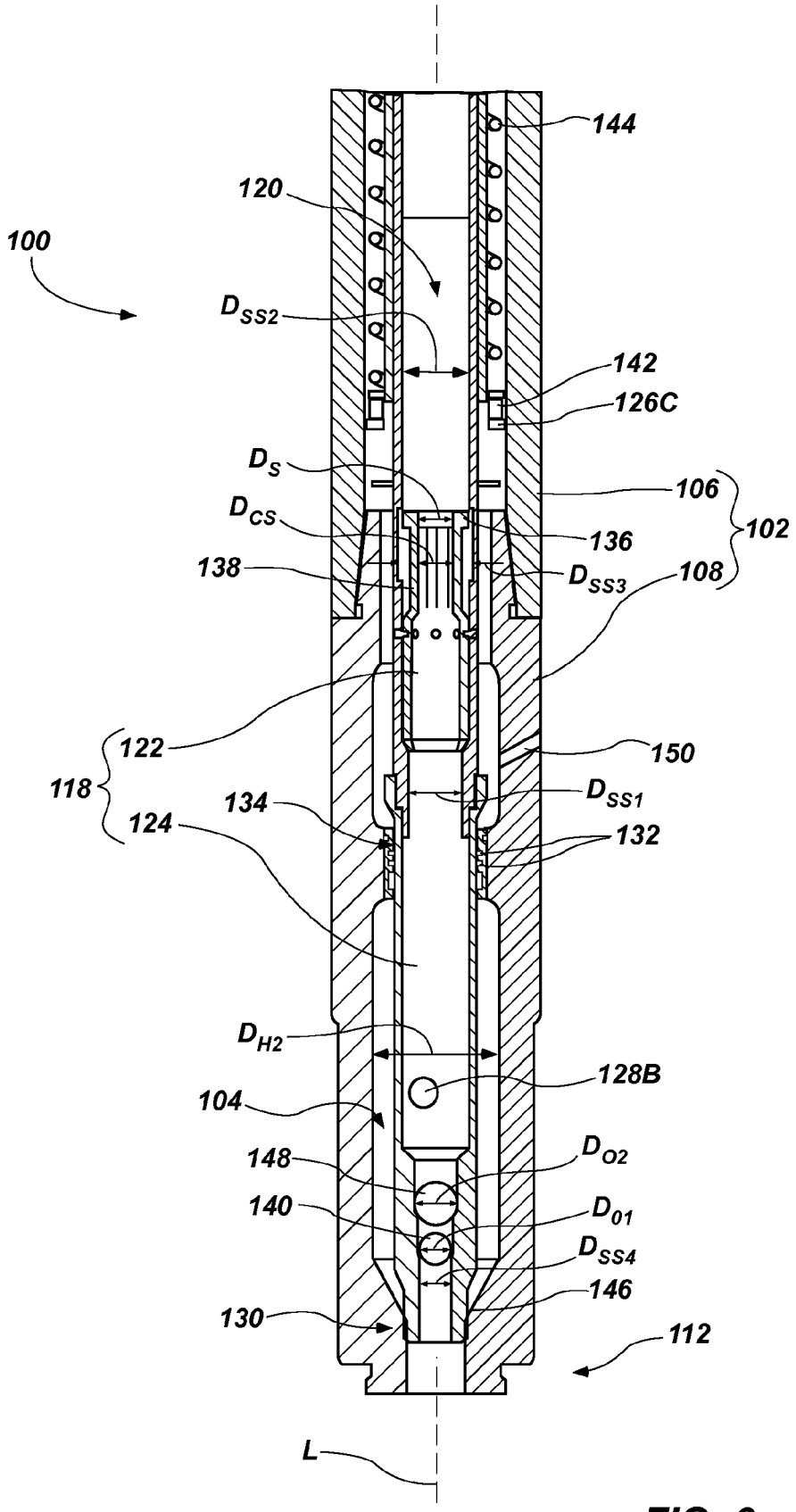
FIG. 6 is a cross-sectional view of the expandable reamer of FIG. 2 in the third state.

Referring to FIG. 6, a cross-sectional view of the expandable reamer of FIG. 2 still in the third state is shown. As stated previously, this third state may correspond to a final, de-actuated, retracted state. The second obstruction 148 may pass through the collet sleeve 138 to enable drilling fluid to flow down the axial fluid passageway 120 and out the second ports 128B on the second, opposing side (i.e., the lower side) of the seal 134. For example, the seat 136 and expandable portion of the collet sleeve 138 may be located at a portion of the sliding sleeve 118 having a diameter $D_{SS3}$ greater than the diameter $D_{SS2}$ of the sliding sleeve 118 where the seat 136 and expandable portion of the collet sleeve 138 were initially located in the first seat position. As drilling fluid exerts pressure against the second obstruction 148, the second obstruction 148 may expand the collet sleeve 138 at the second seat position and be forced through the collet sleeve 138. The second obstruction 148 may pass axially down the expandable reamer 100 and come to rest on the first obstruction 140. Thus, drilling fluid may be redirected from the first ports 128A and the push sleeve 142, down the axial fluid passageway 120, and out the second ports 128B into the central bore 104. Drilling fluid may then proceed down past the expandable reamer 100 to other portions of the drill string, such as, for example, a BHA (not shown).

Figure 7:
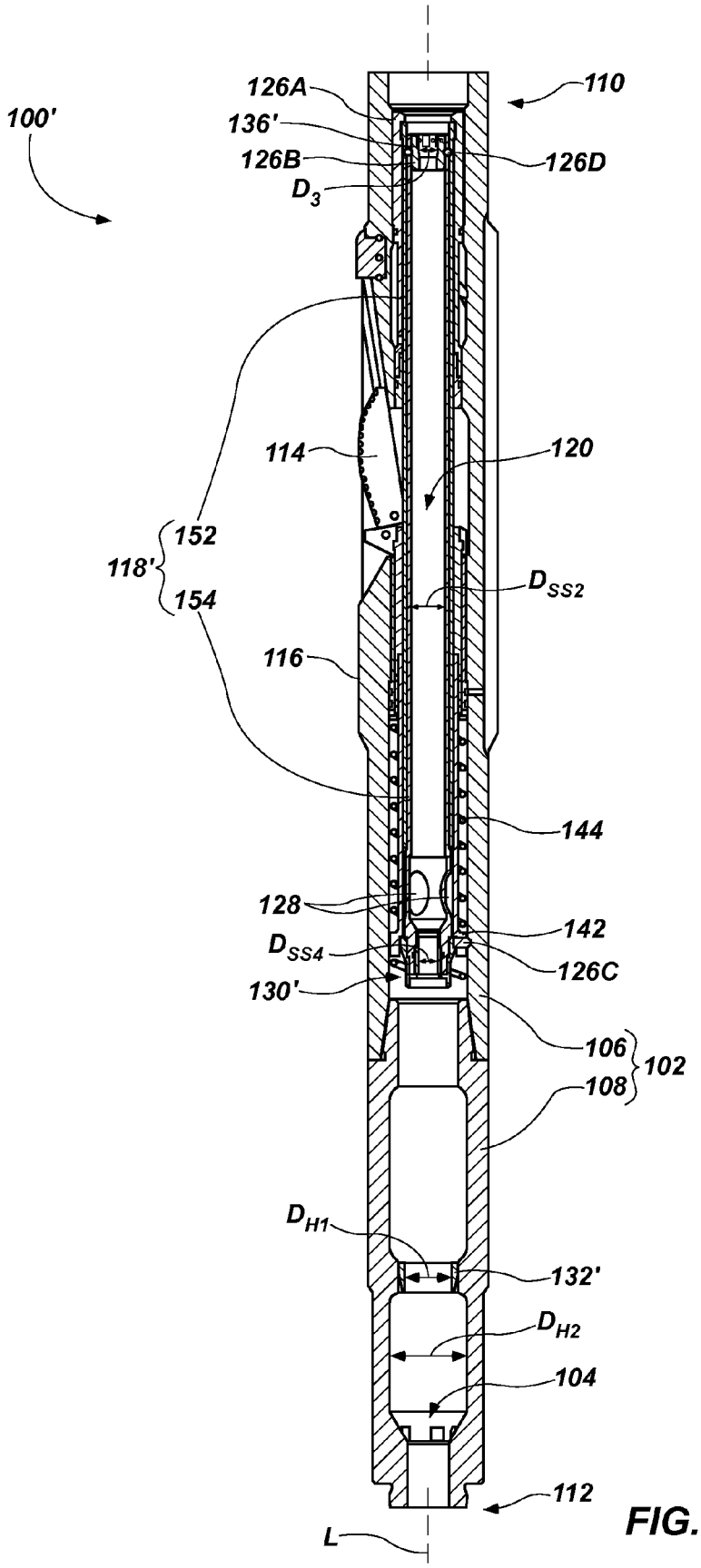
FIG. 7 is a cross-sectional view of another embodiment of an expandable reamer in a first state.

Referring to FIG. 7, a cross-sectional view of another embodiment of an expandable reamer 100' in a first state is shown. This first state may correspond to an initial, pre-actuation, retracted state. The expandable reamer 100' may include an actuation mechanism configured to selectively extend and retract blades 114 of the expandable reamer 100'. The actuation mechanism may include a sliding sleeve 118' disposed within a central bore 104 defined by a housing 102, and the sliding sleeve 118' may be coupled to the housing 102. The sliding sleeve 118' may be in a first sleeve position when coupled to the housing 102 and may be movable to at least a second sleeve position when detached from the housing 102 (see FIGS. 8 and 9). For example, the sliding sleeve 118' may be movable from a first, initial sleeve position, to a second, intermediate sleeve position (see FIG. 8), and a third, final sleeve position (see FIG. 9). The sliding sleeve 118' may comprise a generally cylindrical tubular structure defining an axial fluid passageway 120. The sliding sleeve 118' may comprise a first portion 152 and a second, telescoping portion 154 coupled to the first portion 152. The first portion 152 may comprise a first tubular member disposed within the central bore 104 of the housing 102 and coupled to the housing 102 and the second, telescoping portion 154 may comprise a second tubular member disposed within and coupled to the first portion 152.

The sliding sleeve 118' may be configured to move relative to the housing 102 from the first sleeve position to the second and third sleeve positions (see FIGS. 8 and 9) to alter a flow path of drilling fluid through the expandable reamer 100'. For example, the first portion 152 of the sliding sleeve 118' may be coupled to the housing 102 by detachable hardware 126A. The detachable hardware 126A may comprise, for example, locking dogs, exploding bolts, or shear screws. When detached, the detachable hardware 126A may enable the sliding sleeve 118' to move axially (e.g., by sliding axially downward) relative to the housing 102 from the first sleeve position to the second sleeve position (see FIG. 8). In addition, the second, telescoping portion 154 may be configured to move relative to the first portion 152 from the second sleeve position (see FIG. 8) to the third sleeve position (see FIG. 9) to alter the flow path of drilling fluid through the expandable reamer 100'. For example, the second, telescoping portion 154 may be coupled to the first portion 152 by detachable hardware 126D. The detachable hardware 126D may comprise, for example, locking dogs, exploding bolts, or shear screws. When detached, the second, telescoping portion 154 may move relative to the first portion 152 from the second sleeve position (see FIG. 8) to the third sleeve position (see FIG. 9), while remaining at least partially within the first portion 152.

The sliding sleeve 118' may comprise at least one port 128 in a sidewall of the sliding sleeve 118'. For example, the sliding sleeve 118' may comprise a plurality of ports 128 through the sidewall of the second, telescoping portion 154 proximate an end 130' (e.g., a lower end) of the sliding sleeve 118'. When the sliding sleeve 118' is in the first sleeve position, the ports 128 may be obstructed by the housing 102. For example, a surface of the housing 102 defining the central bore 104 may cover the ports 128, obstructing or at least impeding fluid flow through the ports 128.

An inner diameter $D_{SS}$ of the sliding sleeve 118' may not be constant. For example, the inner diameter $D_{SS4}$ of the sliding sleeve 118' may be smaller (i.e., constricted) at an axial location below the ports 128 (e.g., at the end 130' of the sliding sleeve 118' when the sliding sleeve 118' is in the first sleeve position) than the inner diameter $D_{SS2}$ of the sliding sleeve 118' at axial positions at and above the ports 128 when the sliding sleeve 118' is in the first sleeve position. The reduction in inner diameter $D_{SS4}$ at the end 130' of the sliding sleeve 118' may enable the sliding sleeve 118' to engage with an obstruction. In some embodiments, the end 130' of the sliding sleeve 118' may comprise a seat, for example, a ball seat, a ball trap, a solid seat, an expandable seat, or other seats known in the art for engaging with obstructions to alter flow paths in expandable reamers 100', coupled to the second, telescoping portion 154. Thus, the sliding sleeve 118' may be configured to engage with an obstruction to alter a flow path of drilling fluid through the expandable reamer 100'.

The expandable reamer 100' may include at least one sealing member 132' configured to form a seal between the housing 102 and the sliding sleeve 118'. For example, a sealing member 132' may be coupled to the housing 102 at an axial location below the end 130' of the sliding sleeve 118' when the sliding sleeve 118' is in the first and second sleeve positions (see FIG. 8). Thus, the sealing member 132' may not form a seal 134' (see FIG. 9) between the housing 102 and the sliding sleeve 118' when the sliding sleeve 118' is in the first and second positions (see FIG. 8). The sealing member 132' may selectively form the seal 134' (see FIG. 9) between the housing 102 and the sliding sleeve 118' depending on the sleeve position of the sliding sleeve 118', and specifically depending on the sleeve position of the second, telescoping portion 154 of the sliding sleeve 118'. In other words, the seal 134' (see FIG. 9) may not be formed before extension of the blades 114, but may be formed before or during retraction of the blades 114 from their extended position (see FIG. 8) to their retracted position. The sealing member 132' may comprise, for example, an O-ring, an omni-directional sealing ring, a unidirectional sealing ring, V-packing, and other members for forming seals between components of expandable reamers 100' known in the art. The lower end 130 of the sliding sleeve 118' may be located above the sealing member 132' when the sliding sleeve 118' is in the first and second sleeve positions (see FIG. 8), but may be configured to pass through and engage with the sealing member 132' to form the seal 134' when the sleeve 118' is in the third position (see FIG. 9).

An inner diameter $D_H$ of the housing 102 may not be constant. For example, the inner diameter $D_{H1}$ of the housing 102 may be smaller at an axial location of the sealing member 132' than the inner diameter $D_{H2}$ of the housing 102 at axial locations immediately above and below the sealing member 132'.

A seat 136' may be disposed within and coupled to the sliding sleeve 118'. The seat 136' may be in a first seat position and may be movable to a second seat position (see FIG. 9) when detached from the sliding sleeve 118' to alter flow of drilling fluid through the expandable reamer 100. For example, the seat 136' may be configured to engage with another obstruction to alter a flow path of drilling fluid through the expandable reamer 100'. The seat 136' may comprise, for example, a ball seat, a ball trap, a solid seat, an expandable seat, or other seats known in the art for engaging with obstructions to alter flow paths in expandable reamers 100'. The seat 136' may be configured to engage with the other obstruction and to detach from the sliding sleeve 118' when the second obstruction engages with the seat 136' to move from the first seat position to the second seat position. The seat 136' may have a diameter $D_S$ smaller than a greatest inner diameter $D_{SS2}$ of the sliding sleeve 118', but greater than a smallest inner diameter $D_{SS4}$ of the sliding sleeve 118'. The seat 136' may be coupled to the sliding sleeve 118' by detachable hardware 126B. The detachable hardware 126B may comprise, for example, locking dogs, exploding bolts, or shear screws.

When in use, drilling fluid may flow from the upper end 110 of the expandable reamer 100', down through the axial fluid passageway 120 defined by the sliding sleeve 118', and out the lower end 112 of the expandable reamer 100'. Drilling fluid may optionally flow through the ports 128. The drilling fluid flowing through the ports 128 may be insufficient to actuate the expandable reamer 100' (i.e., to extend the blades 114). In addition, or in the alternative, detachable hardware 126C, such as, for example, locking dogs, shear screws, or exploding bolts, may secure the blades 114 in the retracted state regardless of the pressure of the drilling fluid flowing through the ports 128. Thus, the expandable reamer 100' may remain in the first state until actuated. In the first state of operation of the expandable reamer 100', the plurality of blades 114 may be in the retracted position, the sliding sleeve 118' may be coupled to the housing in the first sleeve position, and the seat 136' may be coupled to the sliding sleeve 118' in the first seat position.

Figure 8:
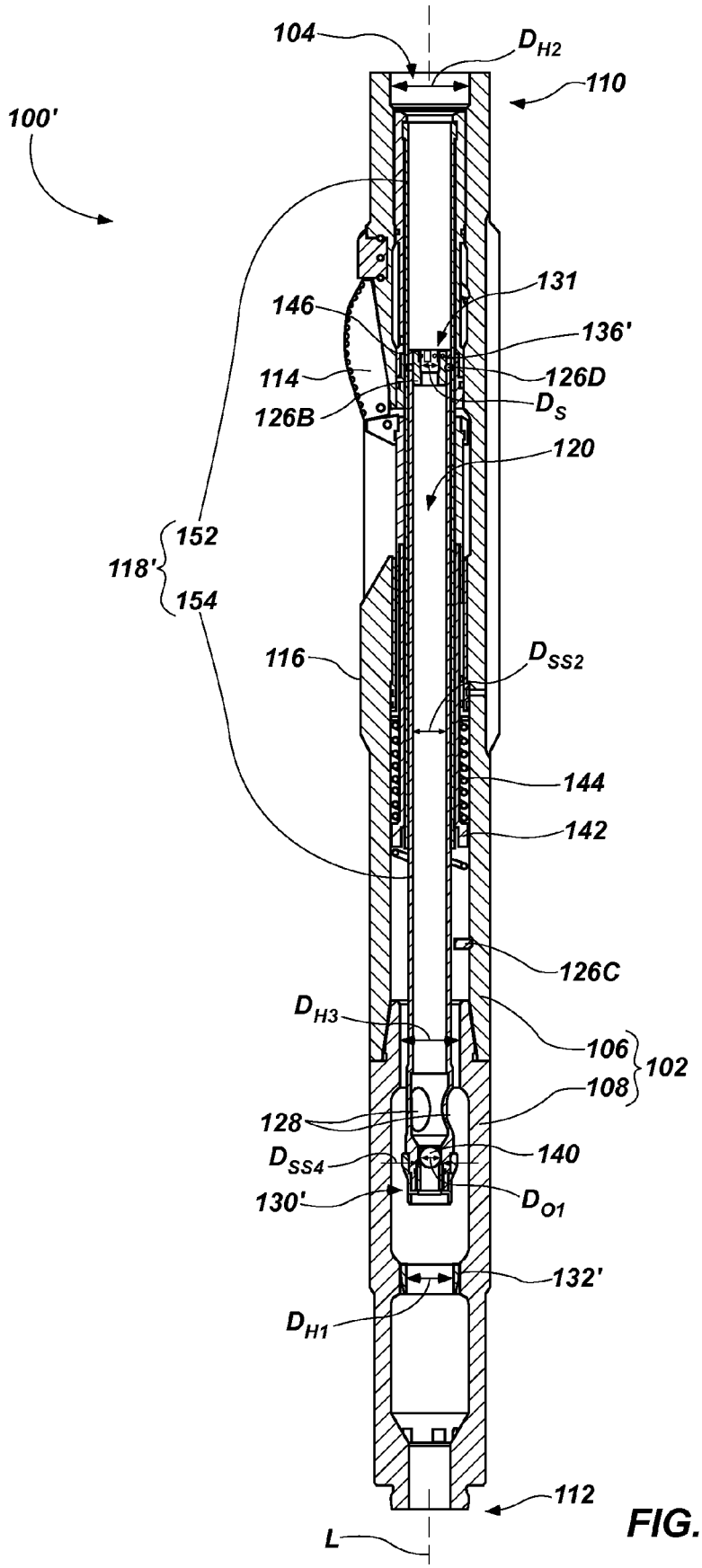
FIG. 8 is a cross-sectional view of the expandable reamer of FIG. 7 in a second state.

Referring to FIG. 8, a cross-sectional view of the expandable reamer 100' of FIG. 7 in a second state is shown. This second state may correspond to a subsequent, actuated, extended state. To place the expandable reamer 100' in the second state, a first obstruction 140 may be placed in the central bore 104. For example, the first obstruction 140 may be dropped into a drilling fluid flow path of a drill string (not shown) and travel down the drill string to the expandable reamer 100', where it may enter the central bore 104. The first obstruction 140 may comprise, for example, a ball (e.g., a sphere or ovoid) comprising a material suitable for use in a downhole environment (e.g., a metal, a polymer, a composite, etc.). The first obstruction 140 may engage with the sliding sleeve 118' to obstruct the axial fluid passageway 120. For example, the first obstruction 140 may have a diameter $D_{O1}$ smaller than the diameter $D_S$ of the seat 136, but greater than the smallest inner diameter $D_{SS4}$ of the sliding sleeve 118'. Thus, the first obstruction 140 may become lodged in the sliding sleeve 118' at the smallest inner diameter $D_{SS4}$ of the sliding sleeve 118.

Obstruction of the axial fluid passageway 120 may move the sliding sleeve 118' relative to the housing 102 from the first sleeve position (see FIG. 7) to the second sleeve position. For example, obstruction of the axial fluid passageway 120 may cause drilling fluid to exert a pressure against the first obstruction 140 engaged with the sliding sleeve 118'. The pressure exerted by the drilling fluid against the first obstruction 140 engaged with the sliding sleeve 118' may be sufficient to detach the sliding sleeve 118' from the housing 102. For example, the pressure exerted by the drilling fluid may be sufficient to shear detachable hardware 126A (see FIG. 2) comprising shear screws coupling the sliding sleeve 118' to the housing 102.

Upon detaching the sliding sleeve 118' from the housing 102, the pressure exerted against the first obstruction 140 engaged with the sliding sleeve 118' may also be sufficient to move the sliding sleeve 118' relative to the housing 102. For example, the sliding sleeve 118' may slide downward in response to the pressure exerted by the drilling fluid from the first sleeve position (see FIG. 7) to the second sleeve position. The sliding sleeve 118' may cease displacing relative to the housing 102 at the second sleeve position when the ports 128 are exposed within the central bore 104 of the housing 102. For example, the ports 128 may move from a portion of the housing 102 having a diameter $D_{H3}$ that obstructs the ports 128 to a portion of the housing 102 having a larger diameter $D_{H2}$ that does not obstruct the ports 128. Drilling fluid may resume flow through the ports 128 to the central bore 104, relieving the pressure against the first obstruction 140 and ceasing movement of the sliding sleeve 118'. In addition or in the alternative, a shoulder at the upper end 131 of the sliding sleeve 118' may engage with a stop 146 (e.g., a ledge) within the central bore 104 defined by the housing 102 to stop movement of the sliding sleeve 118' at the second sleeve position.

Obstruction of the axial fluid passageway 120 may cause the blades 114 to extend. For example, obstruction of the axial fluid passageway 120 may redirect flow of drilling fluid from the axial fluid passageway 120, through the exposed ports 128, to exert a pressure against a push sleeve 142. The pressure exerted by the redirected drilling fluid may be sufficient to move the push sleeve 142 and compress a spring 144 engaged with the push sleeve 142. Movement of the sliding sleeve 118 relative to the housing 102 may also release detachable hardware 126C that previously held the push sleeve 142 and the blades to which the push sleeve 142 is connected in their retracted position. As a specific, non-limiting example, the detachable hardware 126C may comprise locking dogs as disclosed in U.S. Pat. No. 7,900,717, issued Mar. 8, 2011, to Radford et al., or U.S. Pat. No. 8,028,767, issued Oct. 4, 2011, to Radford et al., the disclosure of each of which is incorporated herein in its entirety by this reference. Movement of the push sleeve 142 may translate to corresponding movement of the blades 114. Thus, the blades 114 may be extended from their retracted position to their extended position to engage with a wall of a subterranean formation. In alternative embodiments, obstruction of the axial fluid passageway 120 may redirect flow of drilling fluid from the axial fluid passageway 120, through the exposed ports 128 on the first side of the seal 134 to exert a pressure directly against the blades 114.

The blades 114 may extend after the sliding sleeve 118' moves. For example, drilling fluid flowing through the exposed ports 128 may exert the pressure against the push sleeve 142 to extend the blades 114 and down past the expandable reamer 100' to components of the drill string located below the expandable reamer 100', such as, for example, a BHA (not shown). The first obstruction 140 may remain engaged with the sliding sleeve 118' for so long as the expandable reamer 100' remains in the borehole. In the second state of operation of the expandable reamer 100', the plurality of blades 114 may have moved from their retracted position to their extended position, the sliding sleeve 118' may have moved from a first sleeve position to a second sleeve position, and the seat 136' may remain in the first seat position.

Figure 9:
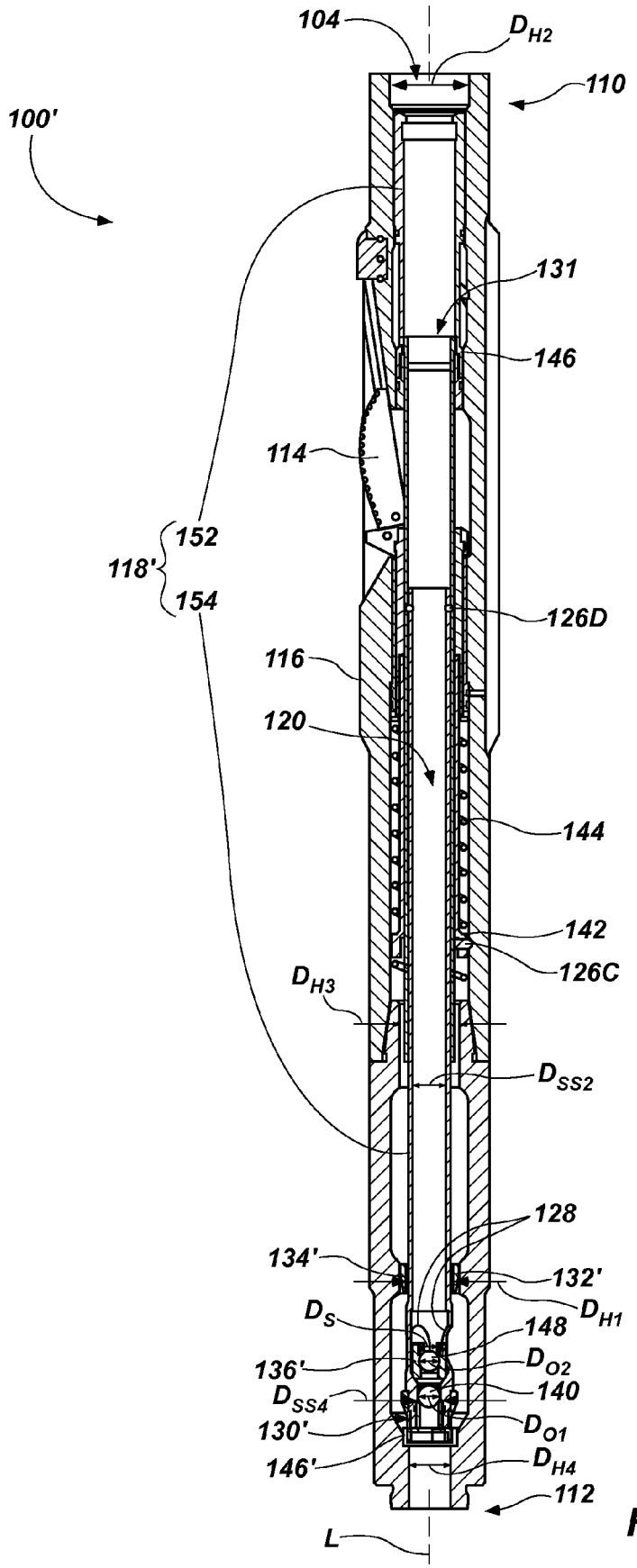
FIG. 9 is a cross-sectional view of the expandable reamer of FIG. 7 in a third state.

Referring to FIG. 9, a cross-sectional view of the expandable reamer of FIG. 7 in a third state is shown. This third state may correspond to a final, de-actuated, retracted state. To place the expandable reamer 100' in the third state, a second obstruction 148 may be placed in the central bore 104. For example, the second obstruction 148 may be dropped into a drilling fluid flow path of a drill string (not shown) and travel down the drill string to the expandable reamer 100', where it may enter the central bore 104. The second obstruction 148 may comprise, for example, a ball (e.g., a sphere or ovoid) comprising a material suitable for use in a downhole environment (e.g., a metal, a polymer, a composite, etc.). The second obstruction 148 may engage with the seat 136' to obstruct the axial fluid passageway 120. For example, the second obstruction 148 may have a diameter $D_{O2}$ greater than the diameter $D_S$ of the seat 136. In other words, the second obstruction 148 may have a diameter $D_{O2}$ greater than a diameter $D_{O1}$ of the first obstruction 140. Thus, the second obstruction 148 may become lodged in the seat 136'.

Obstruction of the axial fluid passageway 120 may cause the seat 136' to detach from the sliding sleeve 118' and move from the first seat position (see FIGS. 7 and 8) to the second seat position. For example, obstruction of the axial fluid passageway 120 may cause drilling fluid to exert a pressure against the second obstruction 148 and the seat 136'. The pressure may be sufficient to detach the seat 136' from the sliding sleeve 118'. For example, the pressure may be sufficient to shear detachable hardware 126B (see FIG. 8) comprising shear screws coupling the seat 136' to the sliding sleeve 118'. Once the seat 136' is detached from the sliding sleeve 118', the seat 136' may move relative to the sliding sleeve 118' from the first seat position (see FIGS. 7 and 8) to the second seat position to redirect flow of the drilling fluid through the expandable reamer 100'.

Movement of the seat 136' from the first seat position (see FIGS. 7 and 8) to the second seat position may release detachable hardware 126D coupling the first portion 152 of the sliding sleeve 118' to the second, telescoping portion 154 of the sliding sleeve 118'. For example, the detached seat 136' may travel axially downward within the sliding sleeve 118' until it contacts the first obstruction 140 engaged with the sliding sleeve 118' at the second seat position. After movement of the seat 136, the detachable hardware 126D, which may comprise locking dogs, may release engagement between the first and second telescoping portions 152 and 154. Accordingly, the second, telescoping portion 154 may move relative to the first portion 152, while at least a portion of the second, telescoping portion 154 may remain within the first portion 152. The end 130' of the sliding sleeve 118' may pass through the sealing member 132', forming a seal 134' between the housing 102 and the sliding sleeve 118'. The second, telescoping portion 154 may cease displacing when the end 130' of the second, telescoping portion 154 engages with a stop 146' coupled to the housing 102. For example, a stop 146' comprising a ring configured to engage with the end 130' of the second, telescoping portion 154 may be coupled to the housing 102 proximate the lower end 112 at a location where the inner diameter $D_{H4}$ of the housing 102 is smaller than the sliding sleeve 118'. The second, telescoping portion 154 may contact the stop 146' and stop displacing relative to the first portion 152. In other words, the sliding sleeve 118' may move from the second sleeve position (see FIG. 8) to the third sleeve position.

The ports 128 may also pass from a first side of the seal 134' (e.g., an upper side above the seal 134'), through the sealing member 132', to a second, opposing side of the seal 134' (e.g., a lower side below the seal 134'). The ports 128 may enable drilling fluid that previously exerted pressure against the push sleeve 142 to exit the sliding sleeve 118' out into the central bore 104 because drilling fluid flowing through the ports 128 may not exert pressure against the push sleeve 142 on the first side of the seal 134'. The spring 144 may extend, displacing the push sleeve 142 and retracting the blades 114 from their extended position to their retracted position. In this way, the blades 114 may be retracted to cease engagement with a subterranean formation in a borehole. This retraction of the blades 114 may be irreversible so long as the expandable reamer 100' remains in the borehole. After the expandable reamer 100' is extracted from the borehole, the various components (e.g., the sliding sleeve 118', the seat 136', and the first and second obstructions 140 and 148) may optionally be reset to the first state (i.e., the initial, pre-actuation, retracted state shown in FIG. 7), and the expandable reamer 100' may be redeployed in the same or another borehole.

Drilling fluid may flow through the ports 128 on the second, opposing side of the seal 134'. Thus, drilling fluid may be redirected from the push sleeve 142, down the axial fluid passageway 120, and out the ports 128 into the central bore 104. Drilling fluid may then proceed down past the expandable reamer 100' to other portions of the drill string, such as, for example, a BHA (not shown). In the third state of operation of the expandable reamer 100', the plurality of blades 114 may return from their extended position to their retracted position, the sliding sleeve 118' may have moved from the second sleeve position to the third sleeve position, and the seat 136' may have moved from the first seat position to the second seat position.

While certain illustrative embodiments have been described in connection with the figures, those of ordinary skill in the art will recognize and appreciate that embodiments of the invention are not limited to those embodiments explicitly shown and described herein. Rather, many additions, deletions, and modifications to the embodiments described herein may be made without departing from the scope of embodiments of the invention as hereinafter claimed, including legal equivalents. In addition, features from one disclosed embodiment may be combined with features of another disclosed embodiment while still being encompassed within the scope of embodiments of the invention as contemplated by the inventor.

What is claimed is:

1. An expandable reamer for earth-boring applications, comprising:

a housing partially defining a fluid flow path extending through the housing;

blades supported by the housing and movable between a retracted position and an extended position;

a sliding sleeve located within and coupled to the housing, the sliding sleeve partially defining the fluid flow path extending through the sliding sleeve and comprising a port in a sidewall of the sliding sleeve, the sliding sleeve being movable between a first longitudinal sleeve position and a second longitudinal sleeve position in response to at least a first obstruction engaging with the sliding sleeve;

a seat connected to the sliding sleeve, the seat being movable between a first longitudinal seat position and a second longitudinal seat position in response to a second obstruction engaging with the seat in response to a second obstruction engaging with the seat; and a sealing member positioned to inhibit fluid flow between a first side of the sealing member and a second, opposing side of the sealing member in a space defined between the housing and the sliding sleeve when the sealing member is engaged with the housing and the sliding sleeve, the port in the sidewall of the sliding sleeve being located on the first side of the sealing member when the sliding sleeve is in the first longitudinal sleeve position and located on the second, opposing side of the sealing member when the sliding sleeve is in the second longitudinal sleeve position, wherein the blades are in the retracted position when the sliding sleeve is in the first longitudinal sleeve position and the seat is in the first longitudinal seat position, the blades are movable to the extended position when the sliding sleeve is in the second longitudinal sleeve position and the seat is in the first longitudinal seat position, and the blades are irreversibly in the retracted position when the sliding sleeve is in the second longitudinal sleeve position, the seat is in the second longitudinal seat position, and the expandable reamer remains in a borehole.

2. The expandable reamer of claim 1, wherein the sealing member is engaged with the housing and the sliding sleeve when the sliding sleeve is in the first longitudinal sleeve position and when the sliding sleeve is in the second longitudinal sleeve position.

3. The expandable reamer of claim 2, wherein the sliding sleeve comprises another port configured to remain on the first side of the sealing member when the sliding sleeve is located in the second longitudinal sleeve position.

4. The expandable reamer of claim 3, wherein the seat comprises a collet.

5. The expandable reamer of claim 4, wherein the collet is positioned to obstruct the another port when the collet is in the second longitudinal seat position.

6. The expandable reamer of claim 1, wherein the sliding sleeve comprises a first portion coupled to the housing and a second, telescoping portion connected to the first portion, the second, telescoping portion being configured to move to the second longitudinal sleeve position when the second, telescoping portion is detached from the first portion.

7. The expandable reamer of claim 6, wherein the seat is directly attached to the sliding sleeve and is positioned to maintain the second, telescoping portion coupled to the first portion when the seat is in the first longitudinal seat position, and wherein the second, telescoping portion is movable to the second longitudinal sleeve position when the seat is in the second longitudinal seat position.

8. The expandable reamer of claim 7, wherein an end of the second, telescoping portion is configured to remain on the first side of the sealing member when the sliding sleeve is in the first longitudinal sleeve position and is configured to engage with and pass through the sealing member when the second, telescoping portion is in the second longitudinal sleeve position.

9. The expandable reamer of claim 8, further comprising a stop member configured to stop movement of the end of the second, telescoping portion after the end has passed through the sealing member.

10. The expandable reamer of claim 1, wherein the sealing member comprises one of an omni-directional sealing member, a unidirectional sealing member, and V-packing members.

11. A method of using an expandable reamer in an earth-boring application, comprising:

flowing a drilling fluid through a fluid flow path partially defined by a housing, the housing supporting blades, the blades being movable between a retracted position and an extended position;

placing a first obstruction in the fluid flow path to engage a sliding sleeve located within the housing, the sliding sleeve partially defining the fluid flow path within the sliding sleeve, and moving the sliding sleeve from a first longitudinal sleeve position toward a second longitudinal sleeve position;

redirecting flow of the drilling fluid from the fluid flow path through a port in the sliding sleeve to exert pressure causing the blades to move from a retracted state to an extended state in response to obstructing the fluid flow path with the first obstruction;

placing a second obstruction in the fluid flow path to engage a seat connected to the sliding sleeve and moving the seat from a first longitudinal seat position to a second longitudinal seat position;

moving the port to a second side of a sealing member positioned to inhibit fluid flow between a first, opposing side of the sealing member and the second side of the sealing member in a space defined between the housing and the sliding sleeve when the sealing member is engaged with the housing and the sliding sleeve, in response to placement of the first obstruction or the second obstruction in the fluid flow path;

redirecting flow of the drilling fluid through the port on the second side of the sealing member at least partially in response to placing the seat in the second longitudinal position; and inducing irreversible retraction of the blades to the retracted position responsive to the redirected flow of the drilling fluid so long as the expandable reamer remains in a borehole.

12. The method of claim 11, further comprising maintaining another port in the sliding sleeve on the first side of the sealing member when the port of the sliding sleeve is positioned on the second side of the sealing member.

13. The method of claim 12, wherein placing the second obstruction in the fluid flow path to engage the seat comprises engaging a collet with the second obstruction.

14. The method of claim 13, wherein engaging the collet with the second obstruction comprises detaching the collet from the sliding sleeve and moving the collet to the second longitudinal seat position in response to pressure of the drilling fluid acting against the second obstruction engaged with the collet.

15. The method of claim 13, wherein redirecting flow of the drilling fluid through the port on the second side of the sealing member comprises redirecting flow of the drilling fluid from the other port on the first side of the sealing member to the port on the second side of the sealing member in response to obstructing the another port utilizing the collet in the second longitudinal seat position.

16. The method of claim 15, further comprising passing the second obstruction through the collet by expanding the collet.

17. The method of claim 11, wherein the sliding sleeve comprises a first portion coupled to the housing and a second, telescoping portion coupled to the first portion, and wherein placing the second obstruction in the fluid flow path to engage the seat comprises detaching the second, telescoping portion of the sliding sleeve from the first portion of the sliding sleeve and moving the second, telescoping portion to the second longitudinal sleeve position in response to positioning the seat in the second longitudinal seat position.

18. The method of claim 17, wherein positioning the port on the second side of the sealing member comprises engaging the sealing member with the sliding sleeve by displacing an end of the second, telescoping portion of the sliding sleeve from the first side of the sealing member, through the sealing member, to the second side of the sealing member.

19. The method of claim 18, further comprising engaging the end of the second, telescoping portion with a stop member configured to stop movement of the sliding sleeve after the end has passed through the sealing member.

20. The method of claim 11, further comprising selecting the second obstruction to have an average diameter larger than an average diameter of the first obstruction.

* * * * *